US010772786B2

(12) United States Patent
Suzuki et al.

(10) Patent No.: US 10,772,786 B2
(45) Date of Patent: Sep. 15, 2020

(54) LOAD-RELIEVING APPARATUS

(71) Applicant: TOYOTA JIDOSHA KABUSHIKI KAISHA, Toyota-shi (JP)

(72) Inventors: Kanako Suzuki, Toyota (JP); Norihiko Kawada, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 34 days.

(21) Appl. No.: 16/108,944

(22) Filed: Aug. 22, 2018

(65) Prior Publication Data

US 2019/0083351 A1 Mar. 21, 2019

(30) Foreign Application Priority Data

Sep. 21, 2017 (JP) ..... 2017-181357

(51) Int. Cl.
*A61H 3/00* (2006.01)
*A61H 1/02* (2006.01)
(Continued)

(52) U.S. Cl.
CPC ..... *A61H 3/008* (2013.01); *A61H 1/024* (2013.01); *A61H 1/0229* (2013.01); *A63B 21/153* (2013.01); *B66D 1/12* (2013.01); *B66D 1/28* (2013.01); *B66D 1/36* (2013.01); *B66D 1/505* (2013.01); *A61H 1/0255* (2013.01);
(Continued)

(58) Field of Classification Search
CPC ..... A61H 3/008; A61H 1/024; A61H 1/0229; A61H 2003/007; A61H 1/0255; A61H 2201/12; A61H 2201/1652; A61H 2201/164; A61H 3/00; B66D 1/505; B66D 1/12; B66D 1/36; B66D 1/28; A63B 21/153; A63B 24/0087; A63B 22/0235; A63B 21/00181
See application file for complete search history.

(56) References Cited

U.S. PATENT DOCUMENTS 3,645,503 A 2/1972 Doerfling
4,635,875 A * 1/1987 Apple ..... B66D 1/36 242/155 BW
(Continued)

FOREIGN PATENT DOCUMENTS

EP 1 595 522 A1 11/2005
EP 2 949 366 A1 12/2015
(Continued)

*Primary Examiner* — Garrett K Atkinson
(74) *Attorney, Agent, or Firm* — Oblon, McClelland, Maier & Neustadt, L.L.P.

(57) ABSTRACT

A load-relieving apparatus includes a wire cable 36 with a free end and a fixed end opposite to the free end, a locking part 361 being attached to the free end, a winding part 334 configured to wind the wire cable 36 from a fixed-end side thereof, a pulley 335 interposed between the winding part 334 and the locking part 361, and configured to stretch the wire cable therebetween, and a cover 336 with a through hole 338H formed therein through which the wire cable 36 is inserted, the cover 336 being interposed between the locking part 361 and the pulley 335, and formed so as to cover at least a part of the pulley 335. Further, the through hole 338H is configured so that a relative position of the through hole 338H with respect to a rotation axis of the pulley 335 changes.

9 Claims, 12 Drawing Sheets

(51) Int. Cl.

| | |
|---|---|
| ***B66D 1/28*** | (2006.01) |
| ***B66D 1/36*** | (2006.01) |
| ***A63B 21/00*** | (2006.01) |
| ***B66D 1/12*** | (2006.01) |
| ***B66D 1/50*** | (2006.01) |

(52) U.S. Cl.
CPC .... *A61H 2003/007* (2013.01); *A61H 2201/12* (2013.01); *A61H 2201/164* (2013.01); *A61H 2201/1652* (2013.01)

(56) References Cited

U.S. PATENT DOCUMENTS 4,724,827 A * 2/1988 Schenck ..... A61H 1/0288 601/40
5,667,461 A * 9/1997 Hall ..... A61H 1/0229 472/15
6,123,649 A * 9/2000 Lee ..... A63B 21/153 482/51
6,666,831 B1 * 12/2003 Edgerton ..... A61H 1/0237 600/587
6,796,926 B2 * 9/2004 Reinkensmeyer ... A61B 5/1038 482/51
7,331,906 B2 * 2/2008 He ..... A61H 1/0237 482/69
7,494,450 B2 * 2/2009 Solomon ..... A61H 1/0229 482/51
7,887,471 B2 * 2/2011 McSorley ..... A63B 21/0552 482/136
7,998,040 B2 * 8/2011 Kram ..... A63B 21/4015 482/124
8,057,410 B2 * 11/2011 Angold ..... A61H 3/00 601/35
8,608,479 B2 * 12/2013 Liu ..... A61H 1/024 434/255
9,638,163 B2 * 5/2017 Holloway ..... B66C 1/108
10,465,663 B2 * 11/2019 Holloway ..... F03D 80/50
2003/0064869 A1 * 4/2003 Reinkensmeyer ... A61B 5/1038 482/100
2004/0087418 A1 * 5/2004 Eldridge ..... A63B 21/157 482/54
2004/0204294 A2 * 10/2004 Wilkinson ..... A63B 21/015 482/54
2005/0101448 A1 * 5/2005 He ..... A61H 1/0237 482/54
2008/0300118 A1 * 12/2008 Wehrell ..... A63B 21/04 482/129
2012/0004581 A1 * 1/2012 Dinon ..... A61H 1/0237 601/23
2013/0130866 A1 * 5/2013 Wehrell ..... A61H 1/0229 482/5
2013/0225371 A1 * 8/2013 Harrer ..... A63B 21/0552 482/8
2015/0232307 A1 * 8/2015 Holloway ..... B66C 1/108 414/800
2017/0027803 A1 2/2017 Agrawal et al.
2017/0218927 A1 * 8/2017 Holloway ..... B66D 1/36

FOREIGN PATENT DOCUMENTS

| | | | |
|---|---|---|---|
| FR | 1177481 | A | 4/1959 |
| JP | 2002-543021 | | 12/2002 |
| JP | 2004-141517 | | 5/2004 |
| JP | 2005-344385 | | 12/2005 |
| JP | 2009-523684 | | 6/2009 |
| JP | 2017-108991 | A | 6/2017 |
| WO | WO 00/066479 | A1 | 11/2000 |
| WO | WO 2007/084553 | A2 | 7/2007 |
| WO | 2008/968928 | A1 | 6/2008 |

* cited by examiner

LOAD-RELIEVING APPARATUS

CROSS REFERENCE TO RELATED APPLICATIONS

This application is based upon and claims the benefit of priority from Japanese patent application No. 2017-181357, filed on Sep. 21, 2017, the disclosure of which is incorporated herein in its entirety by reference.

BACKGROUND

The present disclosure relates to a load-relieving apparatus.

Support systems for supporting rehabilitation of patients who suffer from lower-limb paralysis caused by strokes or the like have been developed. Such support systems can enable, for example, patients with paralyzed lower limbs to do walking trainings. In a walking training, a walking assisting apparatus is attached to a leg of a trainee, i.e., a patient with a paralyzed lower limb. The walking assisting apparatus is attached to the paralyzed leg and assists the trainee in performing knee bending/extending motions. The trainee wearing the walking assisting apparatus walks on a treadmill provided in the support apparatus. It should be noted that the walking assisting apparatus or the leg to which the walking assisting apparatus is attached is pulled in an upper-front direction and an upper-rear direction by a load-relieving apparatus. The load-relieving apparatus supports the weight of the walking assisting apparatus and assists the trainee in moving his/her leg by paying out or pulling in wire cables from positions located above and in front of the trainee, and above and behind the trainee.

As an example of a technique related to the above-described load-relieving apparatus, a lifting/lowering apparatus disclosed in Japanese Unexamined Patent Application Publication No. 2004-141517 includes a wire cable with locking means for suspending a suspended object attached to one end thereof, a winding drum for winding up this wire cable, and winding momentum-giving means for giving rotational momentum to the winding drum in a winding direction. Further, in this lifting/lowering apparatus, an insertion nut and a stopper through which the wire cable is inserted are attached to a base plate covering the winding drum, so that the locking means provided at the free end of the wire cable does not come into contact with the winding drum.

SUMMARY

The present inventors have found the following problem. In the above-described load-relieving apparatus, there is a part where the wire cable is wound is directly exposed, which is undesirable in view of safety. Therefore, the above-described load-relieving apparatus is equipped with a cover that eliminates the exposure of the part where the wire cable is wound. Further, in the above-described load-relieving apparatus, a through hole through which the wire cable is inserted is formed in the cover in order to wind or pull the wire cable therethrough. It is desirable that this through hole be small in view of safety. It should be noted that a load-relieving apparatus used in a walking assisting apparatus may assist a trainee in moving his/her leg in a left/right direction of his/her body in addition to the motion in the front/rear direction (e.g., a swinging motion of the leg in the front/rear direction). In such a case, the wire cable of the load-relieving apparatus may be pulled in a direction perpendicular to the motion in the front/rear direction of the body (e.g., the leg swinging motion) in addition to the direction parallel to the motion in the front/rear direction of the body (e.g., the leg swinging motion). However, when the related technique disclosed in Japanese Unexamined Patent Application Publication No. 2004-141517 is used for the above-described walking training apparatus, the wire cable is repeatedly paid out and pulled in in a state where the wire cable is in contact with the cover of the winding drum. When the wire cable is repeatedly paid out and pulled in in the state where the wire cable is in contact with the cover, the wire cable could be worn out. When the wire cable is worn out, the cost for maintaining the apparatus could increase.

The present disclosure has been made to solve the above-described problem and an object thereof is to provide a load-relieving apparatus capable of suppressing wear of a wire cable.

A first exemplary aspect is a load-relieving apparatus including:

a wire cable with a free end and a fixed end opposite to the free end, a locking part being attached to the free end;

a winding part configured to wind the wire cable from a fixed-end side thereof;

a pulley interposed between the winding part and the locking part, and configured to stretch the wire cable therebetween; and a cover with a through hole formed therein through which the wire cable is inserted, the cover being interposed between the locking part and the pulley, and formed so as to cover at least a part of the pulley, in which the cover (the through hole) is configured so that a relative position of the cover (the through hole) with respect to a rotation axis of the pulley changes (is variable).

By the above-described configuration, the cover can be moved so that its relative position changes with respect to the pulley (the rotation axis of the pulley). Therefore, the cover can follow the movement of the wire cable. In other words, the through hole of the cover can follow the movement of the wire cable.

According to the present disclosure, it is possible to provide a load-relieving apparatus capable of suppressing wear of a wire cable.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

A first embodiment according to the present disclosure is described hereinafter with reference to the drawings.

Figure 1:
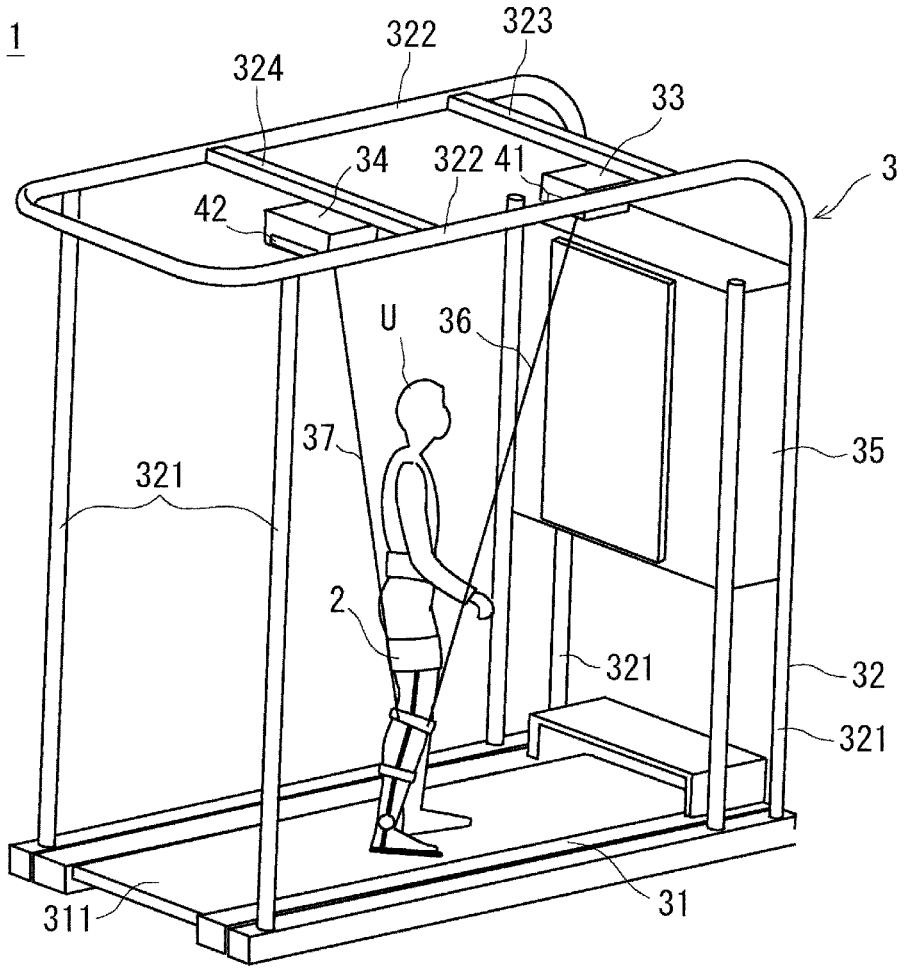
FIG. 1 is a perspective view showing a schematic configuration of a walking training system according to a first embodiment.

FIG. 1 is a perspective view showing a schematic configuration of a walking training system 1 according to the first embodiment. The walking training system 1 according to this embodiment is, for example, a system for enabling a trainee U such as a patient having hemiplegia caused by a stroke to do a walking training. As shown in FIG. 1, the walking training system 1 includes a walking assisting apparatus 2 attached to a leg of the trainee U and a training apparatus 3 by which the trainee U does a walking training.

The walking assisting apparatus 2 is attached to, for example, a diseased leg of a trainee U who does a walking training (in FIG. 1, a right leg of the trainee U) and assists the trainee U in his/her walking. The walking assisting apparatus 2 is an apparatus that is attached to a paralyzed leg and assists the patient in performing knee bending/extending motions. The walking assisting apparatus 2 includes an upper thigh frame, a lower thigh frame connected to the upper thigh frame through a knee joint part, and a sole frame connected to the lower thigh frame through an ankle joint part. Further, the walking assisting apparatus 2 includes a drive unit and rotationally drives the knee joint part or the ankle joint part.

The training apparatus 3 includes a treadmill 31, a frame main body 32, a first load-relieving apparatus 33, a second load-relieving apparatus 34, first and second wire-cable length detection units 41 and 42, which serve as detection means, and a control apparatus 35.

The treadmill 31 includes a ring-shaped rotatable belt conveyor 311 on which the trainee U walks. The trainee U gets on the belt conveyor 311 and walks thereon according to the movement of the belt conveyor 311.

The frame main body 32 includes two pairs of pillar frames 321 vertically disposed on the treadmill 31, a pair of lengthwise frames 322 extending in the front/rear direction and connected to respective pillar frames 321, and front and rear crosswise frames 323 and 324 extending in the left/right direction and connected to each of the lengthwise frames 322. Note that the structure of the frame main body 32 is not limited to this example. The frame main body 32 may have an arbitrary frame structure as long as it can properly fix the first and second load-relieving apparatus 33 and 34 thereto.

The first load-relieving apparatus 33 supports the weight of the walking assisting apparatus and assists the trainee in moving his/her leg by paying out or pulling in the wire from a position located above and in front of the trainee. The first load-relieving apparatus 33 is disposed in a position located above the trainee U and in front of the trainee U in the traveling direction. For example, the first load-relieving apparatus 33 is disposed in the front crosswise frame 323, which is located above the trainee U and in front of the trainee U in the traveling direction. The first load-relieving apparatus 33 pulls the leg of the trainee U to which the walking assisting apparatus 2 is attached upward and forward through a first wire cable 36. The first load-relieving apparatus 33 is connected to the control apparatus 35 (which will be described later) through a wiring line or the like. Details of the first load-relieving apparatus 33 will be described later.

One end of the first wire cable 36 hangs down from the first load-relieving apparatus 33 and is attached directly or indirectly to the leg of the trainee U. For example, one end of the first wire cable 36 is attached to the walking assisting apparatus 2 attached to the leg of the trainee U. The other end of the first wire cable 36 is supported in the first load-relieving apparatus 33 and wound around a winding mechanism.

The second load-relieving apparatus 34 supports the weight of the walking assisting apparatus and assists the trainee in moving his/her leg by paying out or pulling in the wire cable from a position located above and behind the trainee. The second load-relieving apparatus 34 is disposed in a position located above the trainee U and behind the trainee U in the traveling direction. For example, the second load-relieving apparatus 34 is disposed in the rear crosswise frame 324, which is located above the trainee U and behind the trainee U in the traveling direction. The second load-relieving apparatus 34 pulls the leg of the trainee U to which the walking assisting apparatus 2 is attached upward and rearward through a second wire cable 37. The second load-relieving apparatus 34 is composed of, for example, a winding mechanism such as a drum that winds and rewinds the second wire cable 37, a motor that drives the winding mechanism, and so on. The second load-relieving apparatus 34 is connected to the control apparatus 35 (which will be described later) through a wiring line or the like. The second load-relieving apparatus 34 has a configuration similar to that of the first load-relieving apparatus. Details of the second load-relieving apparatus 34 will be described later.

One end of the second wire cable 37 hangs down from the second load-relieving apparatus 34 and is attached directly or indirectly to the leg of the trainee U. For example, one end of the second wire cable 37 is attached to the walking assisting apparatus 2 attached to the leg of the trainee U. The other end of the second wire cable 37 is supported in the second load-relieving apparatus 34 and wound around a winding mechanism.

The detection means detects paid-out lengths of the first and second wire cables 36 and 37. For example, the detecting means includes a first wire-cable length detection unit 41 and a second wire-cable length detection unit 42. The first wire-cable length detection unit 41 is, for example, a sensor such as a rotary encoder that is provided on a winding shaft of the winding mechanism of the first load-relieving apparatus 33 and detects a rotation angle of the winding shaft. A length (a winding amount) by which the winding mechanism has wound the first wire cable 36 is calculated from a detection signal of the first wire-cable length detection unit 41. Further, the paid-out length of the first wire cable 36 is detected (i.e., calculated) by subtracting this winding amount from the already-known total length of the first wire cable 36. The first wire-cable length detection unit 41 is connected to the control apparatus 35 (which will be described later) through a wiring line or the like.

The second wire-cable length detection unit 42 is, for example, a sensor such as a rotary encoder that is provided on a winding shaft of the winding mechanism of the second load-relieving apparatus 34 and detects a rotation angle of the winding shaft. A length (a winding amount) by which the winding mechanism has wound the second wire cable 37 is calculated from a detection signal of the second wire-cable length detection unit 42. Further, the paid-out length of the second wire cable 37 is detected (i.e., calculated) by subtracting this winding amount from the already-known total length of the second wire cable 37. The second wire-cable length detection unit 42 is connected to the control apparatus 35 (which will be described later) through a wiring line or the like. Note that the above-described detection means is not limited to those composed of the first and second wire-cable length detection units 41 and 42. Any means capable of detecting (or measuring) the paid-out lengths of the first and second wire cables 36 and 37 may be used. For example, image pick-up means such as a camera that detects external-appearance information (a position) of a wire cable may be used.

The control apparatus 35 controls pulling forces by which the first and second load-relieving apparatuses 33 and 34 respectively pull the wire cables, and controls the operation performed by the walking assisting apparatus 2. For example, the control apparatus 35 detects that the leg of the trainee U to which the walking assisting apparatus 2 is attached is lifted from the ground (i.e., from the belt conveyer) or set down on the ground. That is, the control apparatus 35 can detect a timing at which the leg of the trainee to which the walking assisting apparatus 2 is attached changes from a leg-standing state to a leg-idling state, and a timing at which the leg changes from the leg-idling state to the leg-standing state based on sensor data supplied from a ground-contact sensor. Upon detecting the timing at which the leg changes from the leg-standing state to the leg-idling state, the control apparatus 35 starts to control a motor unit included in the walking assisting apparatus at that timing.

For example, the control apparatus 35 is composed of hardware mainly using a microcomputer including a CPU (Central Processing Unit) that performs arithmetic processing, control processing, and so on, a ROM (Read Only Memory) that stores an arithmetic program, a control program, etc. to be executed by the CPU, a RAM (Random Access Memory) that stores various types of data, and an interface unit (I/F) that externally receives and outputs signals. The CPU, the ROM, the RAM, and the interface unit are connected with each other through a data bus or the like.

Next, details of the first and second load-relieving apparatuses 33 and 34 are described with reference to FIGS. 2 to 4. The first and second load-relieving apparatuses 33 and 34 have configurations similar to each other, except that they are engaged with (i.e., fixed to) frames different from each other. In the following description, only the first load-relieving apparatus 33 is described. However, the same matters also apply to the second load-relieving apparatus 34.

Figure 2:
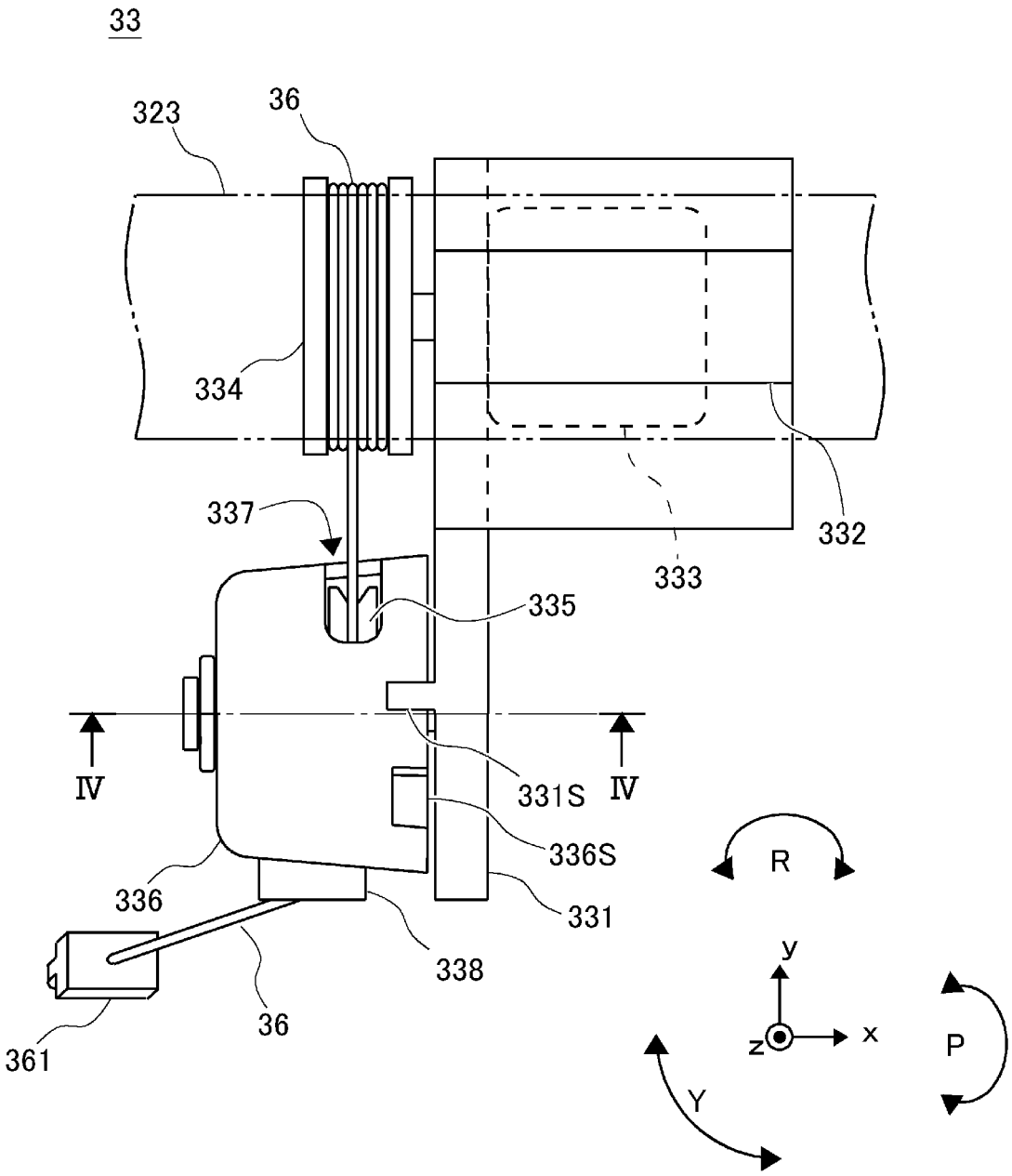
FIG. 2 is a top view of a load-relieving apparatus according to the first embodiment.
Figure 3:
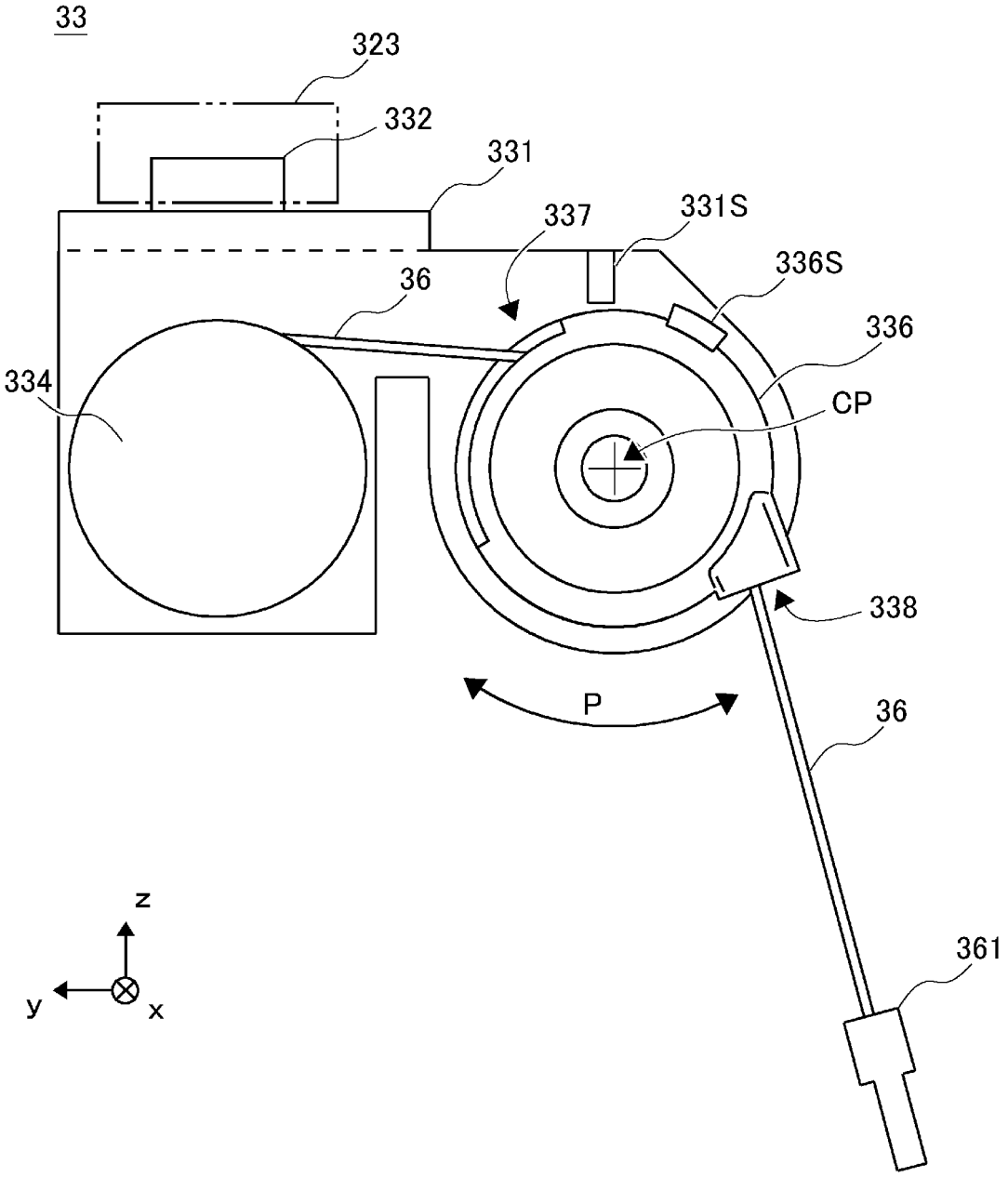
FIG. 3 is a side view of the load-relieving apparatus according to the first embodiment.

FIG. 2 is a top view of a load-relieving apparatus according to the first embodiment. FIG. 3 is a side view of the first load-relieving apparatus according to the first embodiment. FIG. 4 is a front view of the load-relieving apparatus according to the first embodiment. FIG. 2 shows a right-handed xyz-coordinate system in addition to the top view of the load-relieving apparatus 33. That is, a vertical direction in the drawing indicates a z-axis direction in the xyz-coordinate system, and the front side is the plus side in the z-axis direction. A horizontal direction in the drawing indicates an x-axis direction in the xyz-coordinate system, and the right side is the plus side in the x-axis direction. A vertical direction in the drawing indicates a y-axis direction in the xyz-coordinate system, and the upper side is the plus side in the y-axis direction. Note that right-handed xyz-coordinate systems shown in FIGS. 2 to 11 are shown only for the sake of convenience for explaining positional relations among components. The z-axis direction in FIG. 2 coincides with the z-axis directions in FIGS. 3 to 11.

Further, in the following description, a swinging direction of a wire cable or the like, or a rotation direction of an object is defined as follows. A direction of a rotation around the x-axis indicated by an arrow P is defined as a pitch direction. A direction of a rotation around the y-axis indicated by an arrow R is defined as a roll direction. A direction of a rotation about the z-axis indicated by an arrow Y is defined as a yaw direction.

The first load-relieving apparatus 33 mainly includes a first wire cable 36, a wire locking member 361, a support plate 331, an apparatus fixing part 332, a drive unit 333, a winding part 334, a pulley 335, and a cover 336.

The first wire cable 36 has a free end to which the wire locking member 361 is attached and a fixed end opposite to the free end. The free end of the first wire cable 36 hangs down from the first load-relieving apparatus 33 and the wire locking member 361 is attached directly or indirectly to a leg of a trainee U. The fixed end of the first wire cable 36 is fixed to the winding part 334. Further, the first wire cable 36 is wound around the winding part 334.

The wire locking member 361 is a locking component attached to the free end of the first wire cable 36. The wire locking member 361 includes a locking piece 362 such as a hole or a hook for locking the wire locking member 361 in the walking assisting apparatus 2.

The support plate 331 is a support component that supports each structure of the load-relieving apparatus. More specifically, the support plate 331 supports the drive unit 333, the winding part 334, and the pulley 335.

The support plate 331 includes an apparatus fixing part 332. The apparatus fixing part 332 is engaged with the front crosswise frame 323 and is fixed by arbitrary fixing means (not shown) so that the support plate 331 does not move relative to the front crosswise frame 323.

The support plate 331 includes a cover stopper 331S. The cover stopper 331S is a component for restricting the rotation of the cover 336. The cover stopper 331S is provided to stop the movement of the cover 336 in the rotation direction by coming into contact with a corresponding contact part 336S of the cover 336, and thereby prevent the cover 336 from making one rotation or more.

The drive unit 333 is connected to the winding part 334 and rotates the winding part 334. The drive unit 333 is formed by driving means including a motor. The driving unit 333 is controlled by the control unit 35 and rotates the winding part 334 in order to pay out or pull in the first wire cable 36 as described above. Note that instead of being a motor, the driving unit 333 may be momentum-giving means using a tension coil spring, a spiral spring, or the like.

The winding part 334 is a drum-shaped component that winds the fixed-end side of the first wire cable 36. The winding part 334 is connected to the drive unit 333, and is configured so that the drum-shaped component is rotated by the drive unit 333. The winding amount of the first wire cable 36 wound by the winding part 334 or the length of the cable that has been paid out by the winding part 334 is controlled by the above-described first wire-cable length detection unit 41 (not shown), the drive unit 333, and the control apparatus 35.

The pulley 335 is interposed between the winding part 334 and the wire locking member 361, and stretches the first wire cable 36. By being interposed between the winding part 334 and the wire locking member 361, the pulley 335 guides the first wire cable 36 while preventing the first wire cable 36 from being excessively bent.

The cover 336 is a hollow spindle-shaped component that is formed so as to cover at least a part of the pulley 335 in order to prevent the pulley from being directly exposed. The cover 336 is rotatably locked on the same axis as an axis CR which is the rotation center of the pulley 335 (a direction indicated by an arrow P in FIG. 3). The cover 336 includes a communication hole 337, a stopper 338, and a contact part 336S. The first wire cable 36 paid out from the winding part 334 is inserted through the communication hole 337. Further, the first wire cable 36 paid out from the pulley is inserted through the stopper 338.

That is, the first wire cable 36 is paid out from the winding part 334, passes through the communication hole 337, and is stretched through the pulley 335. Then, the first wire cable 36 paid out from the pulley 335 passes through the stopper 338 and is connected to the wire locking member 361.

The stopper 338 is formed so that the wire locking member 361 does not come into contact with the pulley 335 when the first wire cable 36 is wound around the winding part 334 and the wire locking member 361 is thereby pulled into the stopper 338. FIG. 4 shows details of the stopper 338. The stopper 338 has a through hole 338H through which the first wire cable 36 inserted in such a manner that it can pass through the through hole 338H without restraint. The through hole 338H extends in a direction parallel to the axis CR. In other words, the through hole 338H has a slit shape extending parallel to an axial direction of the rotation axis of the pulley 335. Specifically, the through hole 338H is formed so that its width 338A in the axial direction of the axis CR becomes longer than its width 338B in a tangential direction of the axis CR. Further, in order to prevent the wire locking member 361 from passing through the through hole 338H, the through hole 338H is formed so that its width 338A in the axial direction of the axis CR becomes narrower than the width of the wire locking member 361.

The contact part 336S is a component for restricting the rotation of the cover 336. The contact part 336S is formed in a place in which it comes into contact with the cover stopper 331S. Therefore, when the first wire cable 36 is wound around the winding part 334 and the wire locking member 361 is pulled into the fixed-end side, the wire locking member 361 comes into contact with the stopper 338 and hence the stopper 338 no longer continues to get any closer to the pulley 335. When the winding part 334 further winds the first wire cable 36, the cover 336 rotates to a position where the contact part 336S comes into contact with the cover stopper 331S. When the cover 336 rotates to the position where the contact part 336S is in contact with the cover stopper 331S, the cover 336 stops rotating. Therefore, the wire locking member 361 is no longer pulled into the fixed-end side. Note that the cover stopper 331S and the contact part 336S may have forms different from those shown in FIGS. 2 to 4 as long as they restrict the rotation of the cover 336. Further, the cover stopper 331S and the contact part 336S may restrict the rotation of the cover 336 in a direction opposite to the direction in which the wire locking member 361 is pulled in.

Figure 5:
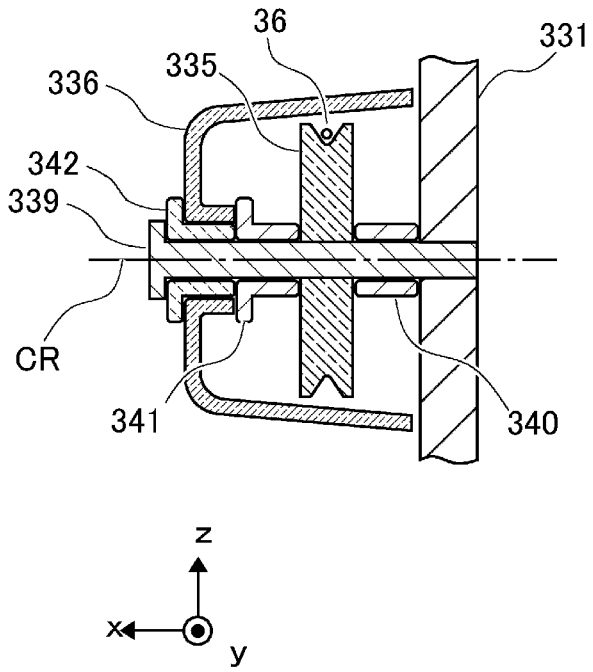
FIG. 5 is a cross section of the load-relieving apparatus according to the first embodiment.

Next, a structure of a part where the pulley 335 and the cover 336 are disposed is described in detail with reference to FIG. 5. FIG. 5 is a cross section of the load-relieving apparatus according to the first embodiment. FIG. 5 shows a cross section IV in FIG. 2. In the first load-relieving apparatus 33, a shaft 339 is provided in a protruding state in the support plate 331. A brim for dislodging prevention is provided at a tip of the shaft 339. As viewed from the support plate 331 side, a first collar 340, a pulley 335, a second collar 341, and a third collar 342 are put on the shaft 339 in this order. Further, a cover 336 is pivotally supported on the outer circumference of the third collar 342. Further, the cover 336 is locked in the thrust direction of the shaft 339 by brims of the second and third collars 341 and 342 to such a degree that the cover 336 does not rattle in the thrust direction. By the above-described structure, the pulley 335 and the cover 336 are rotatably fixed in the thrust direction of the shaft 339 while being prevented from rattling.

Although both the pulley 335 and the cover 336 are pivotally supported on the shaft 339, the means for supporting the cover 336 is not limited to this example. For example, the cover 336 may be supported on a support component different from the shaft 339. Further, the rotation center of the pulley 335 and the rotation center of the cover 336 may be different from each other. In such a case, it is preferable that the rotation axes of the pulley 335 and the cover 336 be roughly parallel to each other. That is, the through hole 338H of the cover 336 is formed so that the cover 336 can rotate around an axis parallel to the rotation axis of the pulley 335. In this way, the through hole 338H of the cover 336 can follow the movement of the pulley 335 in the pitch direction.

Further, the cover 336 may have no rotation axis and may be configured to perform a reciprocating motion. In such a case, the through hole 338H of the cover 336 is formed so as to be able to reciprocate in a direction perpendicular to the rotation axis of the pulley 335. In this way, the through hole 338H of the cover 336 can follow the movement of the pulley 335 in the pitch direction.

Further, the shape of the cover 336 is not limited to the hollow spindle shape as described above. That is, the cover 336 may be, for example, a hollow cubic shape, a curved planar shape, or a combination of a plurality of flat surfaces and curved surfaces as long as it has the above-described function.

Further, the form of the cover 336 is not limited to the above-described structure. That is, the only requirement for the cover 336 is that a relative position of a part 336A of the cover 336 including the through hole 338H should be variable (movable) with respect to a part 336B of the other part of the cover 336, so that the cover 336 should have a function of making a relative position of the through hole 338H variable (movable) with respect to the rotation axis of the pulley 335. For example, the cover 336 may be formed as a flat surface (spherical surface) sliding mechanism composed of a pair of a part 336A having a curved-surface (or flat-surface) shape and a part 336B having a curved-surface (or flat-surface) shape corresponding to the curved-surface (or flat-surface) shape of the part 336A. Alternatively, for example, the cover 336 may be formed as a movable mechanism composed of a pair of a part 336A formed of a rigid component made of a metal, resin, etc. and a part 336B formed of a soft component made of soft rubber etc.

Next, a use state of the first load-relieving apparatus 33 is described with reference to FIGS. 6 to 8.

Figure 6:
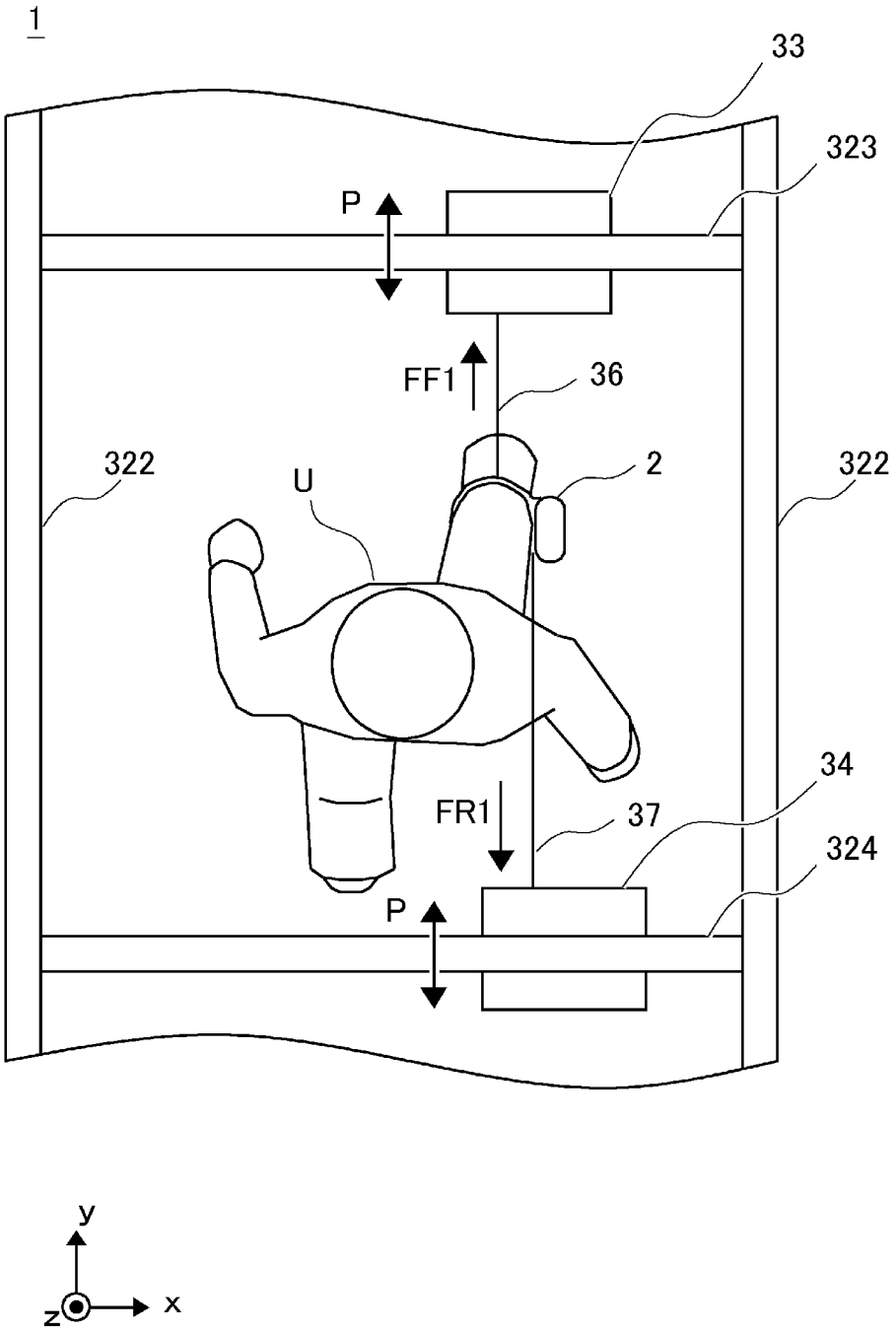
FIG. 6 is a top view of the walking training system according to the first embodiment.

FIG. 6 is a top view of a walking training system according to the first embodiment. FIG. 6 shows a state in a walking training performed by a trainee U. The walking training system 1 is configured so that paid-out lengths of the first and second wire cables 36 and 37 change according to the walking performed by the trainee U. A component in the z-axis direction of a tensile force FF1 applied by the first load-relieving apparatus 33 and a component in the z-axis direction of a tensile force FR1 applied by the second load-relieving apparatus 34 support the weight of the walking assisting apparatus 2. A component in the y-axis direction of the tensile force FF1 applied by the first load-relieving apparatus 33 assists a forward swinging motion in the traveling direction of the leg of the trainee U to which the walking assisting apparatus 2 is attached. A component in the y-axis direction of the tensile force FR1 applied by the second load-relieving apparatus 34 assists a rearward swinging motion in the traveling direction of the leg of the trainee U to which the walking assisting apparatus 2 is attached. In this way, it is possible to reduce the walking load of the trainee U in the walking training.

Figure 7:
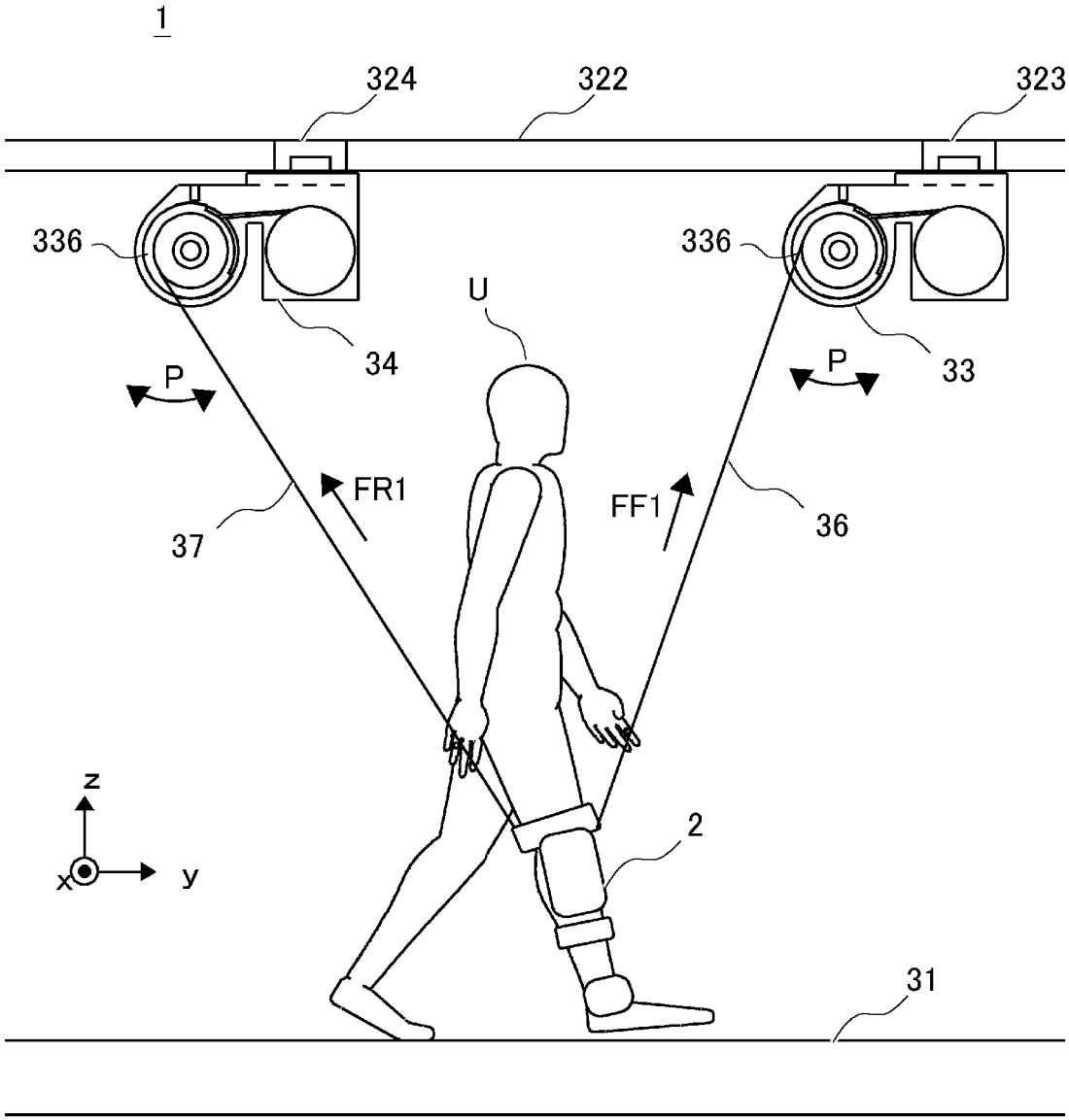
FIG. 7 is a side view of the walking training system according to the first embodiment.
Figure 8:
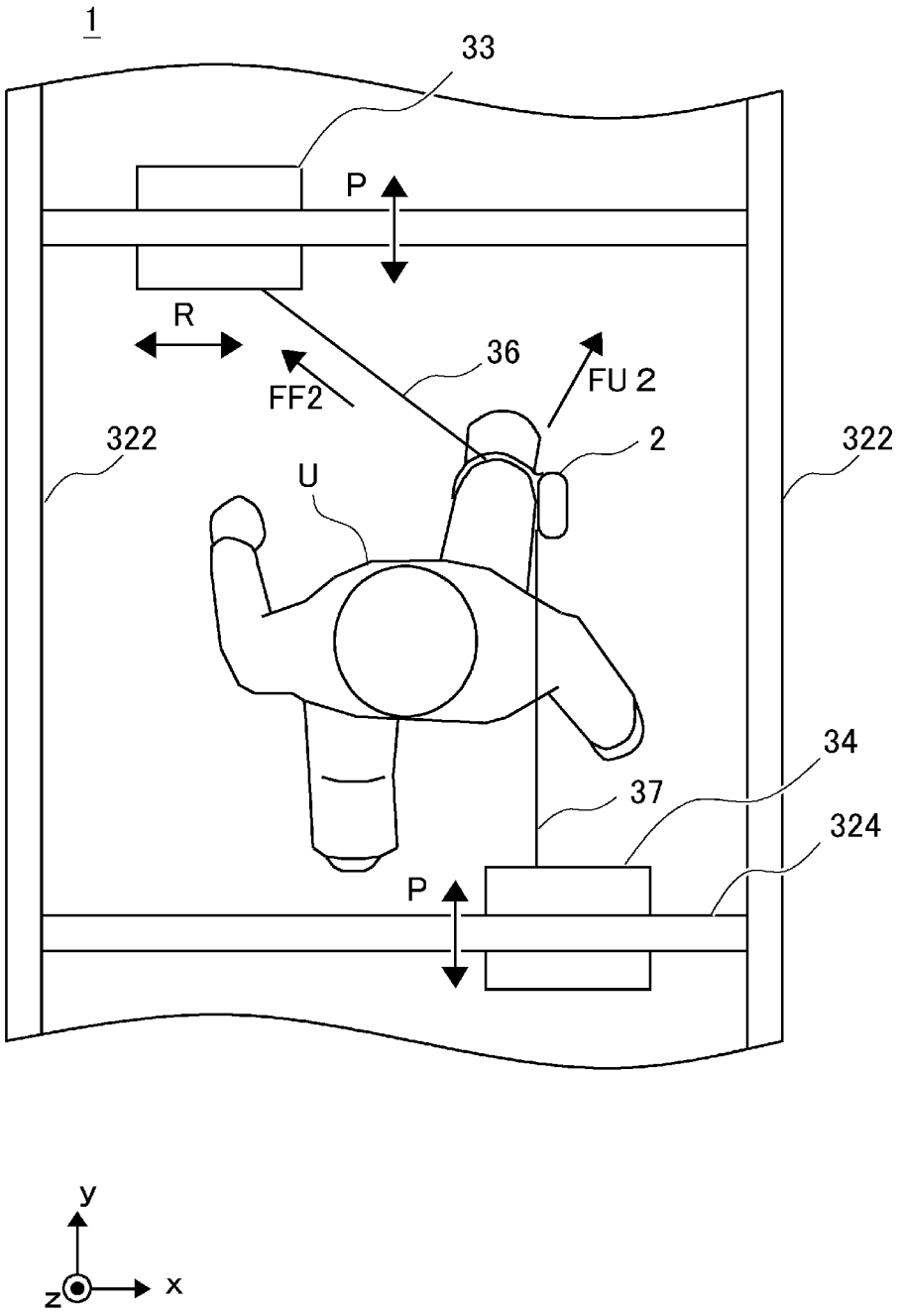
FIG. 8 is a top view of the walking training system according to the first embodiment.

FIG. 7 is a side view of the walking training system according to the first embodiment. FIG. 7 is a side view showing the state shown in FIG. 6. In the state in the walking training shown in FIGS. 6 and 7, the trainee U walks by swinging his/her leg in the y-axis direction. The first load-relieving apparatus 33 is fixed to a position located above and in front of the leg in which the first wire cable 36 is locked. Therefore, the first wire cable 36 pulls the leg in the y-axis positive direction and the z-axis positive direction by a tensile force FF1. Meanwhile, the second load-relieving apparatus 34 is fixed to a position located above and behind the leg in which the second wire cable 37 is locked. Therefore, the second wire cable 37 pulls the leg in the y-axis negative direction and the z-axis positive direction by a tensile force FR1.

The trainee U swings the leg in front of and behind the trainee in the walking training. When doing so, the leg also moves in the z-axis direction in addition to the y-axis direction. Therefore, each of the first and second wire cables 36 and 37, which assist the leg, swings in the pitch direction. In this process, the cover 336 of the first load-relieving apparatus 33 can follow the movement of the first wire cable 36 in the pitch direction. Similarly, the cover 336 of the second load-relieving apparatus 34 can follow the movement of the second wire cable 37 in the pitch direction.

Next, another state in the walking training is described with reference to FIG. 8. FIG. 8 is a top view of the walking training system according to the first embodiment. FIG. 8 shows a state in the walking training performed by the trainee U different from the state shown in FIG. 6. In the example shown in FIG. 8, the forward swinging motion of the leg performed by the trainee U involves an outward rotation. That is, the leg of the trainee U is swung in a direction indicated by an arrow FU2. The arrow FU2 indicates that the swinging motion includes a component in the x-axis direction in addition to components in the y-axis positive direction and in the z-axis direction. Walking involving an excessive outward rotation is not desirable as a walking motion. Therefore, the walking training system 1 assists the walking while pulling the leg in the x-axis negative direction through the first wire cable 36 in order to cancel out the force in the x-axis positive direction indicated by the arrow FU2. In such a walking training state, the first load-relieving apparatus 33 is fixed to a position located above and in front of, and to the left of the trainee U. That is, the first load-relieving apparatus 33 is fixed to a place that is shifted in the x-axis negative direction from the place shown in FIG. 6. In such a case, the first wire cable 36 has a tensile force FF2 having components in the y-axis positive direction, the z-axis positive direction, and the x-axis negative direction. Further, the first wire cable 36 also swings widely in the roll direction in addition to the pitch direction shown in FIG. 7.

Figure 4:
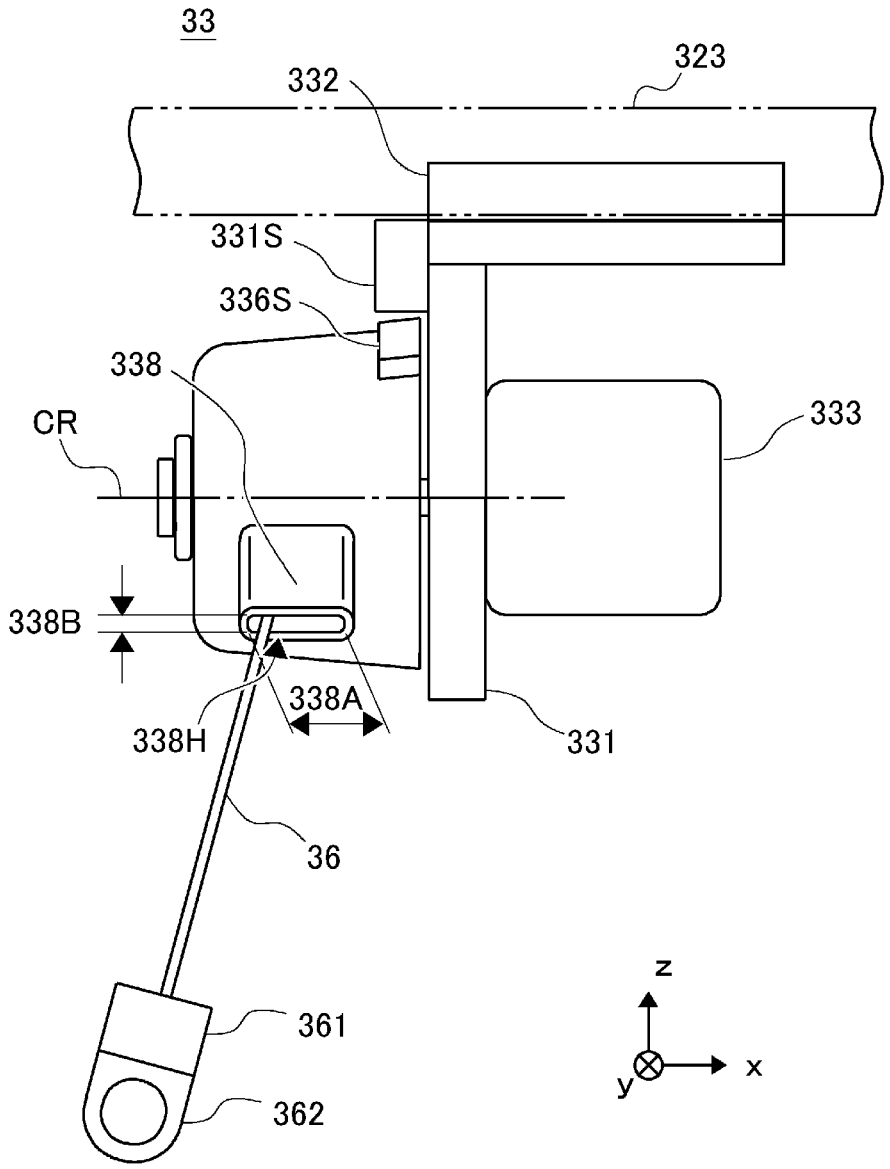
FIG. 4 is a front view of the load-relieving apparatus according to the first embodiment.

As shown in FIG. 4, the cover 336 of the first load-relieving apparatus 33 has the through hole 338H having the width 338A in the x-axis direction. Therefore, the cover 336 of the first load-relieving apparatus 33 can allow a movement of the first wire cable 36 in the roll direction within a range corresponding to the width 338A in the x-axis direction of the through hole 338H.

Figure 9:
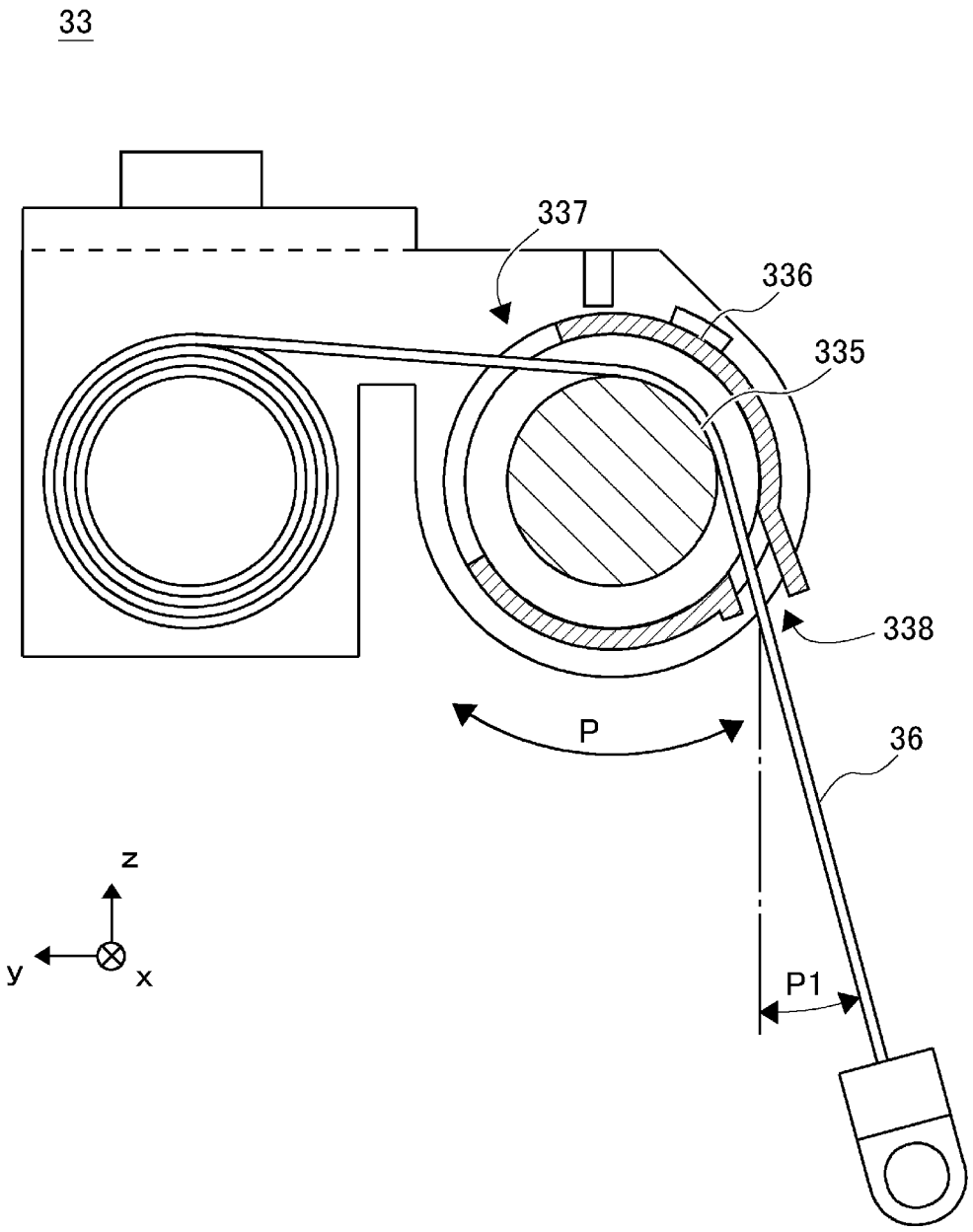
FIG. 9 is a schematic diagram for explaining a movement of a wire cable of the load-relieving apparatus in a pitch direction.
Figure 10:
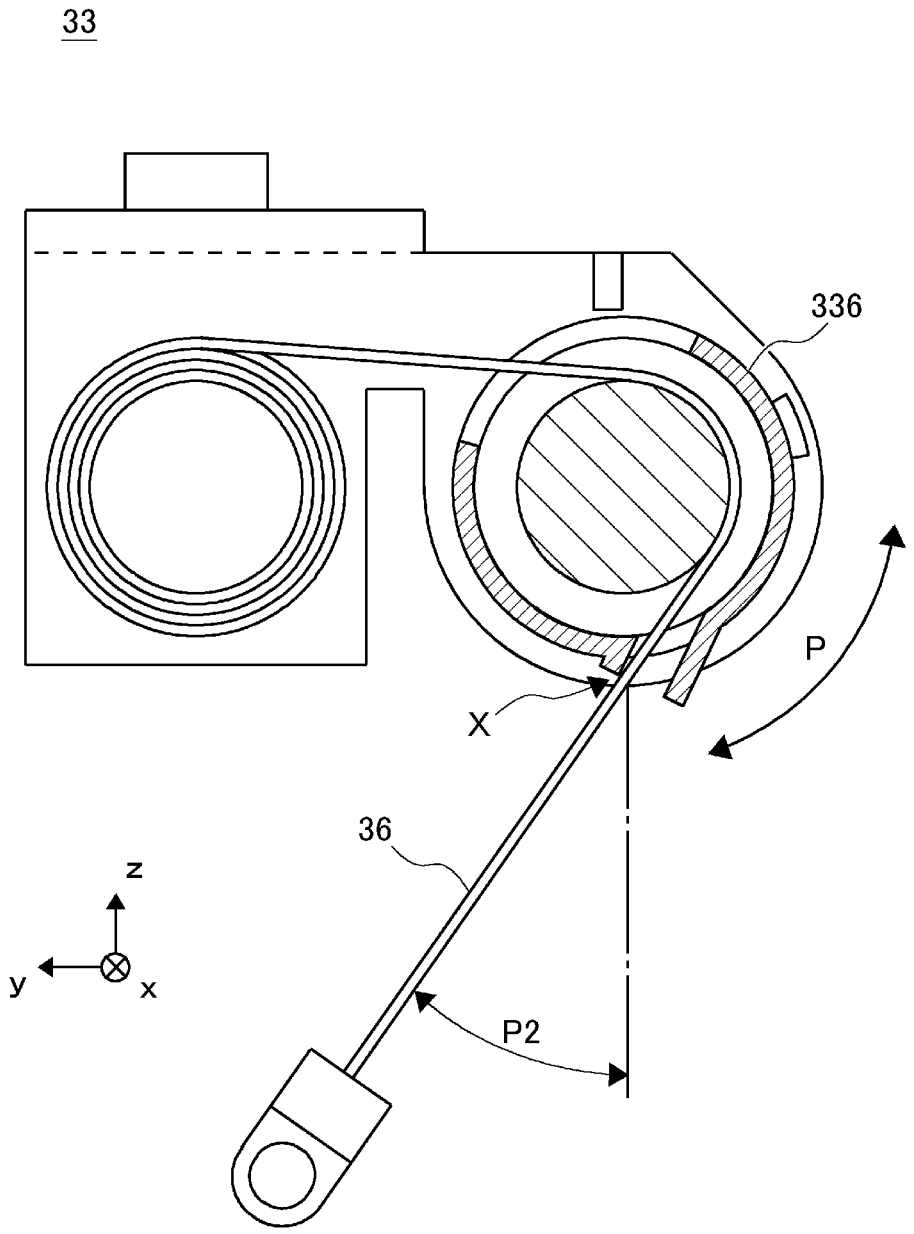
FIG. 10 is a schematic diagram for explaining a movement of the wire cable of the load-relieving apparatus in the pitch direction.

Next, a movement of the cover 336 in the pitch direction is described with reference to FIGS. 9 and 10. FIG. 9 is a schematic diagram for explaining a movement of the wire cable of the load-relieving apparatus in the pitch direction. The first wire cable 36 is paid out from the stopper 338 of the cover 336. In FIG. 9, the first wire cable 36 extends in a position inclined from the z-axis direction by an angle P1. Meanwhile, in FIG. 10, the first wire cable 36 extends in a position inclined from the z-axis direction by an angle P2. In the first load-relieving apparatus 33, since the stopper 338 can move in the rotation direction of the pulley 335 as described above, the stopper 338 can follow the movement of the first wire cable 36.

Note that since the stopper 338 is rotatably fixed, the stopper 338 could come into contact with the first wire cable 36. A contact point X shown in FIG. 10 indicates a state in which the stopper 338 and the first wire cable 36 are in contact with each other. Even in such a state, the first wire cable 36 is not bent by the stopper 338 and hence the first wire cable 36 is not worn at the contact point X. Further, in consideration of the contact between the stopper 338 and the first wire cable 36, the stopper 338 is processed (e.g., machined) so that no edge is present around the through hole 338H.

Figure 11:
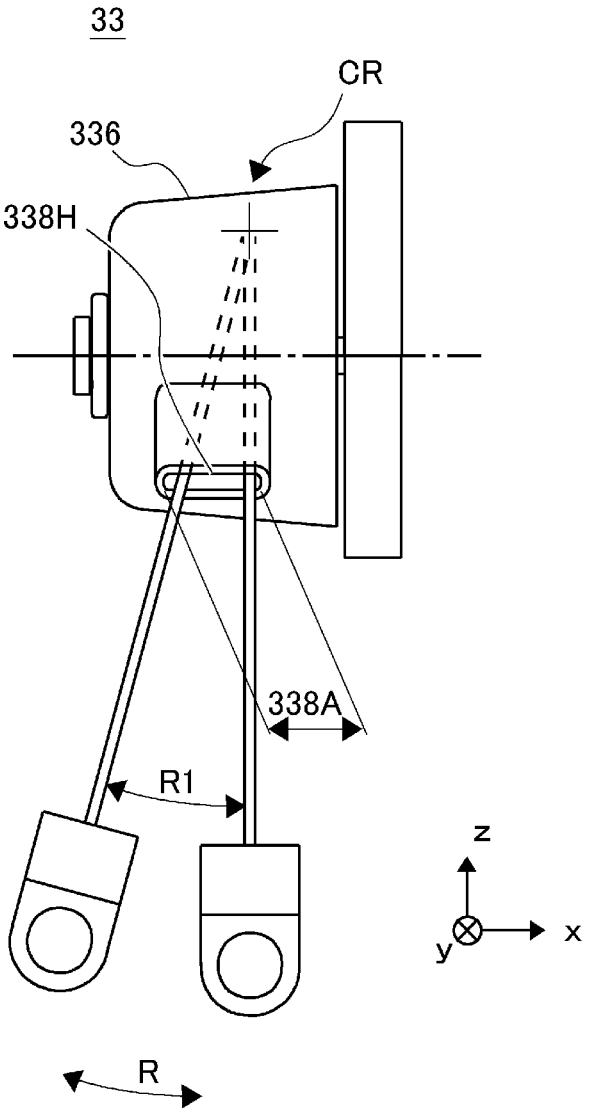
FIG. 11 is a schematic diagram for explaining a movement of the wire cable of the load-relieving apparatus in a roll direction.

Next, a movement of the first wire cable 36 in the roll direction is described with reference to FIG. 11. FIG. 11 is a front view for explaining a movement of the wire of the load-relieving apparatus in the roll direction. The first wire cable 36 swings around the axis CR parallel to the y-axis in the roll direction with the place where the cable is paid out from the pulley 335 being the center of the swing.

The first wire cable 36 paid out from the through hole 338H of the cover 336 can be used without being worn in a range in which the first wire cable 36 does not come into contact with the width 338A in the x-axis direction of the through hole 338H. That is, even if the motion of the leg performed by the trainee U involves an outward rotation as shown in FIG. 8, the first wire cable 36 does not come into contact with the stopper 338, for example, within a range of an angle RI.

In the first embodiment, by the above-described configuration, it is possible to provide a load-relieving apparatus capable of suppressing wear of a wire cable.

Second Embodiment

Figure 12:
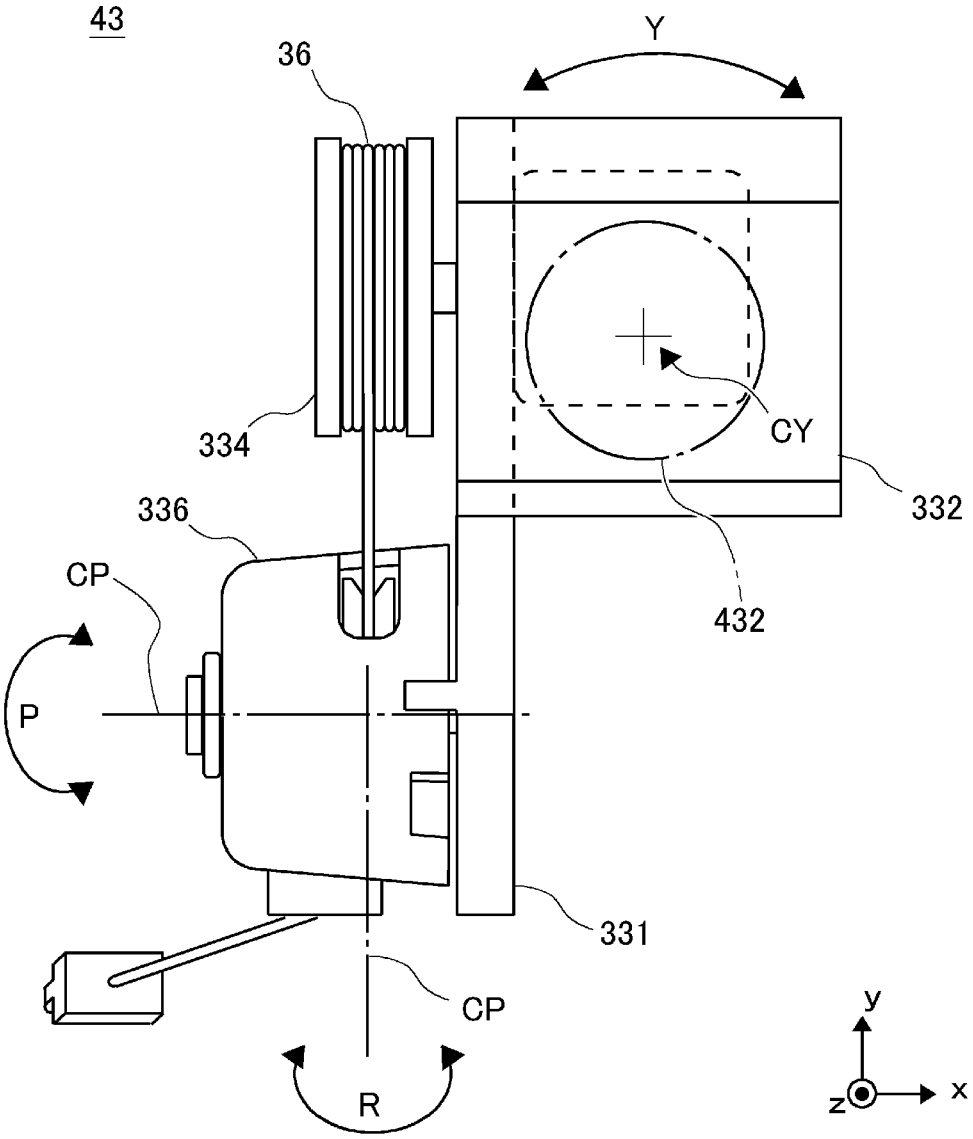
FIG. 12 is a top view of a load-relieving apparatus according to a second embodiment.

Next, a second embodiment is described with reference to FIG. 12. FIG. 12 is a top view of a load-relieving apparatus according to the second embodiment. The load-relieving apparatus 43 according to the second embodiment is substantially the same as the load-relieving apparatus according to the first embodiment, except for the support means disposed between the support plate 331 and the front crosswise frame 323.

The load-relieving apparatus 43 includes a rotation support part 432 between the support plate 331 and the apparatus fixing part 332. The rotation support part 432 is a support component that supports the support plate 331 in such a manner that the support plate 331 can rotate around an axis CY parallel to the z-axis in a direction indicated by an arrow Y. The rotation support part 432 is, for example, a fixing component including a rolling bearing.

In the second embodiment, by the above-described configuration, when a direction in which the trainee U walks (i.e., a y-axis positive direction) is defined as a forward in the walking training system 1, the load-relieving apparatus 43 can provide flexibility around the axis CY in a yaw direction (a direction indicated by an arrow Y). That is, in the load-relieving apparatus 43 according to the second embodiment, the cover (or the through hole) can follow the wire cable in the pitch direction, the roll direction, and the yaw direction. Therefore, the second embodiment can provide a load-relieving apparatus capable of suppressing wear of a wire cable.

Note that the present disclosure is not limited to the above-described embodiments, and various modifications can be made without departing from the spirit and scope of the present disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A load-relieving apparatus for a walking training system comprising:

a wire cable with a free end and a fixed end opposite to the free end, a locking part being attached to the free end;

a winding part configured to wind the wire cable from a fixed-end side thereof;

a pulley interposed between the winding part and the locking part, and configured to stretch the wire cable therebetween; and a cover with a through hole formed therein through which the wire cable is inserted, the cover being interposed between the locking part and the pulley, and formed so as to cover at least a part of the pulley, wherein the through hole is configured so that a relative position of the through hole is movable with respect to a rotation axis of the pulley.

2. The load-relieving apparatus according to claim 1, wherein the through hole is disposed so as to be able to reciprocate in a direction perpendicular to the rotation axis of the pulley.

3. The load-relieving apparatus according to claim 1, wherein the through hole is disposed so as to be able to rotate around an axis parallel to the rotation axis of the pulley.

4. The load-relieving apparatus according to claim 3, wherein the through hole does not allow the locking part to pass therethrough.

5. The load-relieving apparatus according to claim 3, wherein the through hole has a slit shape extending parallel to an axial direction of the rotation axis of the pulley.

6. The load-relieving apparatus according to claim 1, further comprising a support plate configured to support the winding part and the pulley, wherein the support plate includes a sub-rotation axis perpendicular to the rotation axis.

7. The load-relieving apparatus according to claim 1, further comprising a drive unit configured to drive the winding part.

8. The load-relieving apparatus according to claim 1, wherein the cover is rotatably mounted to the pulley such that the cover independently rotates about the rotational axis of the pulley.

9. A walking training system that includes at least one load-relieving apparatus according to claim 1.

* * * * *